United States Patent [19]

Crosby

[11] Patent Number: 4,528,894

[45] Date of Patent: Jul. 16, 1985

[54] HYDROPNEUMATIC DRIVE APPARATUS

[75] Inventor: Michael J. Crosby, Fairview, Pa.

[73] Assignee: Lord Corporation, Erie, Pa.

[21] Appl. No.: 443,262

[22] Filed: Nov. 22, 1982

[51] Int. Cl.[3] ..... F15B 15/22; F15B 21/02

[52] U.S. Cl. ..... 92/12; 91/35; 91/361

[58] Field of Search ..... 92/8, 9, 10, 11, 12, 92/146; 91/363 R, 363 A, 43, 45, 42, 435, 35, 458, 361; 137/625.65; 251/129

[56] References Cited

U.S. PATENT DOCUMENTS

| | | | |
|---|---|---|---|
| 2,441,264 | 5/1948 | Eaton | 92/8 |
| 2,878,873 | 3/1959 | Novak | 164/117 |
| 2,880,708 | 4/1959 | Hayner | 91/363 R |
| 2,891,514 | 6/1959 | Moeller | 92/9 |
| 3,017,865 | 1/1962 | Frantz | 92/9 |
| 3,260,273 | 7/1966 | Hayner | 137/625.65 |
| 3,555,969 | 1/1971 | Shah | 91/363 R |
| 3,802,318 | 4/1974 | Sibbald | 91/4 R |
| 3,807,678 | 4/1974 | Karnopp et al. | 248/358 R |
| 3,813,990 | 6/1974 | Coppola et al. | 91/363 A |
| 3,894,477 | 7/1975 | Tomikawa | 92/10 |
| 4,046,061 | 9/1977 | Stokes | 137/625.65 |
| 4,235,156 | 11/1980 | Olsen | 91/363 R |
| 4,339,984 | 7/1982 | Hühne | 91/42 |

FOREIGN PATENT DOCUMENTS

| | | | |
|---|---|---|---|
| 1313294 | 4/1973 | United Kingdom | 92/9 |

*Primary Examiner*—Robert E. Garrett
*Assistant Examiner*—H. Edward Li
*Attorney, Agent, or Firm*—Joseph H. Heard

[57] ABSTRACT

An active pneumatic mechanism and a passive hydraulic mechanism of the apparatus are so connected with each other and with a driven member that movement imparted by the pneumatic mechanism to the driven member produces, and is controllable by restriction of, hydraulic fluid flow within the hydraulic mechanism. Restriction of the fluid flow to any desired extent is accomplished by command signals directed by a control computer to a valve that preferably is of the type actuable by a torque motor. The command signals produced by the computer are based upon a correlation of data supplied by a computer program with data supplied by a monitor of the positions of the driven member along its path of travel. Precise control of the speeds, accelerations and positions of the driven member are realized.

10 Claims, 5 Drawing Figures

HYDROPNEUMATIC DRIVE APPARATUS

FIELD OF THE INVENTION

This invention relates to hydropneumatic drive apparatuses of the type having an active penumatic mechanism and a passive hydraulic mechanism so connected with each other and with a driven member that movement imparted to the driven member by the active pneumatic mechanism produces, and is controlled by restriction of, fluid flow within the hydraulic mechanism. The hydropneumatic drive apparatus of the present invention is particularly adapted for use in association with industrial manipulators or robots whose optimum utilization requires extremely precise, rapid and versatile control of the motions of their driven members.

BACKGROUND OF THE INVENTION

Industrial drive mechanisms powered by compressed air possess the advantages of being fast-acting, clean and relatively inexpensive to install, operate and maintain. Most industrial plants have existing compressed air sources to which the mechanisms may be readily connected. Minor leakages of compressed air, and exhausting of it into the atmosphere, are usually permissible. The major disadvantage of purely pneumatic drive mechanisms is the fact that their output motions cannot be precisely controlled due to the inherent "springyness" of air, i.e., its capability for large magnitude compression and subsequent expansion.

The output motions of active hydraulic drive mechanisms can be more precisely controlled due to the relative incompressibility of hydraulic fluid in relation to air. However, the pumps and pump motors of active hydraulic drive mechanisms are noisy, expensive from both the acquisition and maintenance viewpoints, and the circuitry for conducting hydraulic fluid to and from such pump and its associated hydraulic fluid to and from such pump and its associated components necessarily includes various fittings potentially capable of hydraulic-fluid leakage.

In recognition of the aforesaid relative advantages and disadvantages of purely pneumatic and purely hydraulic drive mechanisms, the use of hybrid hydropneumatic drive apparatuses has heretofore been proposed. Such apparatuses employ an active pneumatic mechanism and a passive (i.e., "pumpless") hydraulic mechanism connected with each other and with a driven member in such a manner that movement imparted to the driven member by the pneumatic drive mechanism produces, and is controllable by restriction of, flow of fluid within the hydraulic mechanism. In all known prior hydropneumatic drive apparatuses other than those employing valves that are capable of manual adjustment only, the means employed for restricting the flow of fluid within the hydraulic mechanism consists of one or more valves operated by a solenoid or the like and having only two operating conditions, in one of which the fluid flow is either substantially unrestricted or substantially completely restricted, and in the other of which fluid flow is partially restricted to a constant extent. When a single such valve is employed, the only control achievable thereby over the motion of the driven member is to either abruptly halt such motion and/or to abruptly change the speed of the driven member between a maximum-attainable velocity and one other velocity of a lesser constant magnitude. In some of the prior-art hydropneumatic drive apparatuses, of which those disclosed in U.S. Pat. Nos. 2,878,873 and 3,802,318 are illustrative, a plurality of hydraulic fluid control valves of the aforesaid two-condition type are employed in association with each other. Selective actuation of the valves permits the speed of the driven member to be changed either directly or in discrete steps between its maximum attainable velocity and two or three, instead of just one, reduced velocities of predetermined constant magnitudes. While constituting an improvement over apparatuses employing a single two-condition valve for hydraulic fluid control, the multiple-valve apparatuses are similarly capable of effecting only limited variations in the velocity of the driven member, and are totally incapable of controlling the rate of the changes of the velocity of the driven member from one discrete level or magnitude to the next discrete level. The full performance capabilities of more sophisticated types of industrial robots and the like cannot be realized by a hydropneumatic drive apparatus which is capable of varying the speed of the driven robotic member between only a small number of discrete magnitudes or levels and which is incapable of controlling the positive and/or negative acceleration forces imposed upon the driven member during changes in its speed from one such level to the next.

Another significant deficiency in hydropneumatic drive apparatuses employing solenoid-operated valves for restricting the flow of hydraulic fluid is the slowness of operation of such valves. Each transition from one to the other of the valve's operating conditions must be preceded by the establishment or decay of a magnetic field of considerable intensity. The time delay required for such field to build and decay is significant when compared with the high speeds of operation and control desired in some utilizations of industrial manipulators or robots, and would detrimentally affect performance in such utilizations.

The tasks which an industrial robot or the like can be called upon to perform are quite varied, and at least some may require positioning of its driven member within tolerances of a few thousandths of an inch. In order to achieve such precise positioning of the driven member with a hydropneumatic drive apparatus, the latter must firstly include means capable of accurately identifying the position occupied by the driven member at substantially any possible location thereof along its path of travel, as opposed to only those positions happening by chance to exactly coincide with one of a plurality of spaced indicia of an associated measuring device. Secondly, the valve means restricting the flow of hydraulic fluid within the hydraulic mechanism of the apparatus must be capable of achieving quite minute changes in the fluid flow conditions when commanded to do so.

SUMMARY OF THE INVENTION

The present invention provides an improved hydropneumatic drive apparatus possessing all of the previously noted attributes and capabilities desirable for producing controlled motion of the driven member of an industrial manipulator, robot or the like. The drive apparatus can effect controlled movement of the driven member at any desired one or ones of a substantially infinite number of differing speeds. It also can control all accelerations of the driven member, so as to produce an optimum balance between rapidity and safety of operation. The apparatus further possesses the ability to precisely position the driven member at any desired location along its path of travel.

The drive apparatus includes control means, preferably in the form of a programmable computer, which directs control signals to a command-responsive valve means capable of restricting the flow of fluid within the hydraulic mechanism of the drive means. Pursuant to the control signals, the valve means will either establish a condition of substantially unrestricted fluid flow, a condition of substantially completely restricted fluid flow, or any commanded one or ones of a substantially infinite number of partially restricted fluid-flow conditions. Since motion of the member driven by the apparatus is directly related to the fluid flow condition within the passive hydraulic mechanism, substantially infinite variations in both the speed and acceleration of the driven member are possible. To insure that all commanded variations in fluid flow condition are immediately achieved by the valve means, it preferably is of a rapidly-acting type having an actuator which employs a constantly maintained magnetic field.

In its preferred form, the drive apparatus further includes monitoring means for continuously detecting and electronically reporting the positions occupied by the driven member along its path of travel. The monitored position data, which when correlated with time also indicates the speed and acceleration of the driven member, is continuously transmitted to the control computer and is used to adjust the control signals transmitted to the valve means when the effect of such adjustment is to bring the driven member's motion and/or position into more precise conformity with that prescribed by the computer program. Unlike optical gratings and similar position indicators whose accuracy is dependent upon and limited by the distance between spaced indicia thereof, the preferred monitoring means of the present hydropneumatic apparatus is of a type capable of accurately detecting and reporting, without error-producing extrapolation or the like, virtually any position of the driven member.

DESCRIPTION OF THE DRAWINGS

Other features and advantages of the invention will be apparent from the following description of an illustrative embodiment thereof, which should be read in conjunction with the accompanying drawings, in which.

DESCRIPTION OF THE PREFERRED EMBODIMENT

Figure 1:
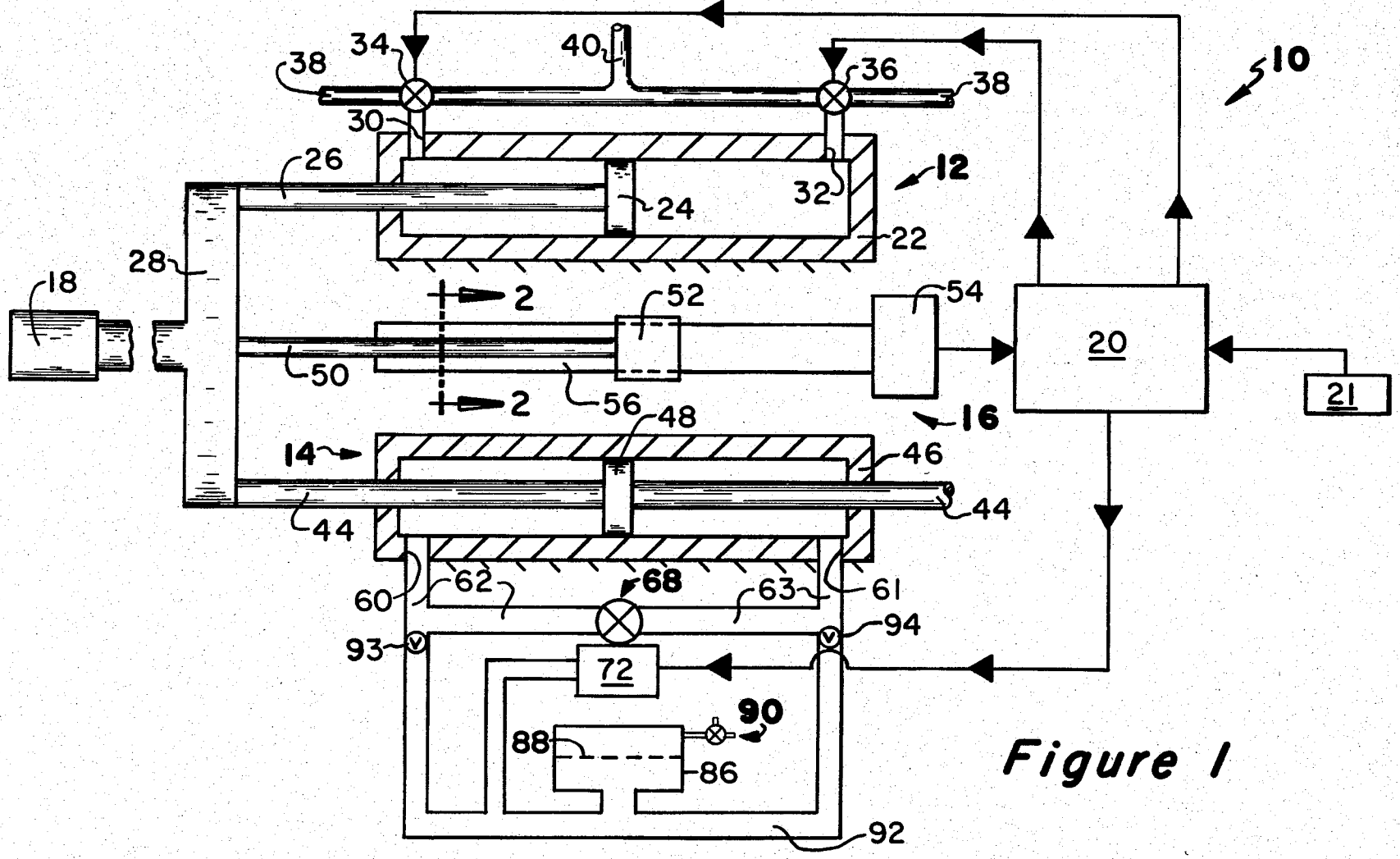
FIG. 1 is a partially diagramatic view, wherein some components are shown in elevation and others is section, of a hydropneumatic drive apparatus in accordance with the invention.

Referring more particularly to the drawings, the hydropneumatic drive apparatus designated in its entirety in FIG. 1 by the numeral 10 includes an active pneumatic drive mechanism in the form of a piston and cylinder assembly 12 and associated pneumatic circuitry, and a passive hydraulic control mechanism in the form of a piston and cylinder assembly 14 and associated hydraulic circuitry. Apparatus 10 further includes monitoring means 16 for continuously monitoring the position of a driven member 18 forming part of an industrial robot (not otherwise shown) or the like with which apparatus 10 is associated in use; and control means preferably and illustratively in the form of a programmable computer 20 that continously receives input data from monitoring means 16 and from an internal or external computer program 21 specifying the movements the member 18 should undergo for optimal performance of its intended function. Computer 20 continuously correlates the aforesaid input data and directs control signals to hereinafter described valve components of apparatus 10, the effect of which is to conform the actual movements of driven member 18 exactly or as closely as possible to the desired optimal movements thereof.

Assembly 12 of the active pneumatic mechanism of apparatus 10 is illustratively of a conventional type consisting of cylinder, piston and rod components 22, 24, 26, respectively. The free end of rod 26 is fixedly connected to a rigid member 28 which in turn is rigidly connected to driven member 18, such that movement of piston 24 to the left or to the right within frame-mounted cylinder 22 produces corresponding leftward or rightward movement of member 18. Ports 30, 32 adjacent the opposite ends of cylinder 22 have electrically-operated control valves 34, 36 respectively associated therewith. Each valve is capable of connecting its associated port with either an exhaust conduit 38, or with a conduit 40 leading to a source of compressed air (not shown). The pressure of the source air is not critical but normally will be approximately 100 psi. Unless restrained as hereinafter described, movement of piston 24 and member 18 to the right ensues when the control signal directed thereto cause valve 34 to communicate port 30 with compressed air conduit 40 and cause valve 36 to communicate port 32 with exhaust conduit 38, while movement in the opposite direction ensues when the aforesaid operating conditions of the valves are reversed.

Piston and cylinder assembly 14 of the hydraulic mechanism of apparatus 10 extends parallel to previously described piston cylinder assembly 12 and is similar thereto. However, rod 44 of assembly 14 preferably and illustratively extends from both sides of the piston 48 within the assembly's frame-mounted cylinder 46, and projects from both ends of the cylinder. Such construction equalizes the areas of the opposite "working" faces of piston 48, and thus causes a force of the same magnitude to be imposed thereon by a given fluid pressure within either end portion of cylinder 46.

One end of rod 44 is affixed to the rigid member 28 interconnecting driven member 18 and rod 26 of pneumatic piston and cylinder assembly 12. Another rod 50, extending parallel to the aforesaid ones and similarly affixed at one end to member 28, is joined at its opposite end to a magnetic head 52 forming part of the means 16 for monitoring the position of driven member 18. Due to their common interconnections with rigid member 28, all movements imparted to driven member 18 by piston 24 of pneumatic assembly 12 are accompanied by simultaneous and corresponding movement of piston 48 of assembly 14 and also by simultaneous and corresponding movement of magnetic head 52 of monitoring means 16.

Figure 2:
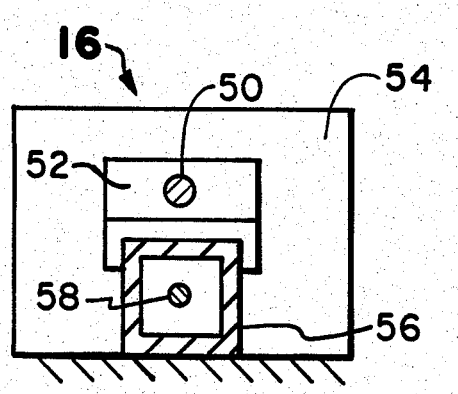
FIG. 2 is a view taken substantially along the line 2—2 of FIG. 1 and showing, partially in section and partially in elevation, components of the monitoring means of the hydropneumatic drive.

Monitoring means 16 is of a known and commercially available type sold by Temposonics, Inc. of Plainview, N.Y. In addition to magnetic head 52, it includes an electronics section 54 from which extends an elongate tubular enclosure 56. Magnetic head 52 closely overlies enclosure 56, which is formed of non-ferrous material, and is displaced longitudinally thereof by movement of driven member 18 due to its previously-described connection via rod 50 with rigid member 28. A waveguide wire 58 (FIG. 2), formed of a nickel-iron alloy with a low thermoelastic coefficient, extends through and centrally of enclosure 56 and through the magnetic field of the head 52 moveable longitudinally of such enclosure. Current pulses applied to wire 58 and interacting with the aforesaid magnetic field generate torsional strain pulses that pass to a fixed receiving station (not shown). The measured time between transmittal of each electronic pulse and reception of each induced torsional pulse is dependent upon the position of head 52 longitudinally of enclosure 56, or more specifically upon the position of the head's magnetic field longitudinally of wire 58. When appropriately processed by the electronic components of monitoring means 16 and/or of control computer 20, the pulse-time data accurately indicates the positions occupied by head 52 and thus driven member 18 during operation of apparatus 10 and, in time-correlated relationship with each other, further indicates the rate and rate of change of the simultaneous movements of head 52 and driven member 18.

Figure 3:
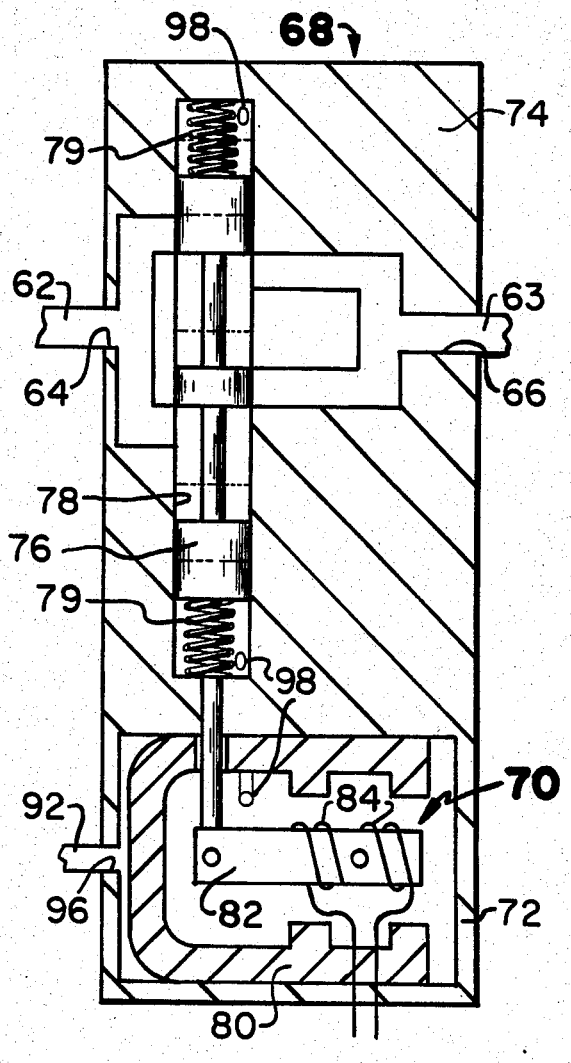
FIG. 3 is an enlarged and partially schematic sectional view of the command responsive valve for restricting fluid flow within the hydraulic mechanism of the apparatus.

Referring once again to previously-described piston and cylinder assembly 14, ports 60, 61 adjacent opposite ends thereof are respectively connected by conduits 62, 63 to ports 64, 66 (see also FIG. 3) of a command-responsive control valve 68 having a torque-motor actuator 70 within a housing 72 connected to or formed integral with the valve's main body 74. As shown in FIG. 3 of the drawings, valve 68 includes a spool member 76 having three enlarged-diameter portions connected by smaller diameter rod portions to each other and to actuator 70. Member 76 is closely received within and is slidable axially of a cylindrical chamber 78 provided within valve body 74 and communicating with dual branches of each valve port 64, 66. Springs 79 adjacent opposite ends of chamber 78 bias spool 76 to its illustrated solid-line position, wherein fluid flow between valve ports 64, 66, and therefore between ports 60, 61 (FIG. 1) of cylinder 46, is totally restricted or blocked. Axial movement of spool 76 to its illustrated phantom-line position permits substantially unrestricted or full fluid flow between valve ports 64, 66, and thus between cylinder ports 60, 61. When spool 76 occupies any of the myriad positions to which it can be moved intermediate its illustrated solid-line and phantom-line ones, fluid flow between valve ports 64, 66 and cylinder ports 60, 61 is partially restricted to an extent dependent upon the specific intermediate position then occupied by the spool. Extremely precise and rapid movement of spool 76 to and between desired ones of its aforesaid positions is effected by torque-motor actuator 70 in response to command signals directed thereto from control computer 20 (FIG. 1). Actuator 70 is of a known construction including a magnet 80 having confronting pole pieces between which a magnetic field (not shown) is constantly maintained. A pivotably mounted armature 82 has its upper portion encircled by a coil 84 and disposed within the aforesaid constant magnetic field. The lower portion of armature 82 is so connected to valve spool 76 as to effect axial proportional movement of the spool in response to pivotal movement of the armature. Pivotal movement of armature 82 is produced by and proportional to the magnitude of control-signal voltages applied by control computer 20 to armature coil 84. Since application of a control-signal voltage to one terminal of coil 84 will produce proportional pivotal movement of armature 82 in one direction, while application of the control-signal voltage to the other coil terminal will produce proportional pivotal movement of the armature in the opposite direction, both the extent and direction of all axial movements of valve spool 76 may be and are rapidly and precisely controlled by computer 20. The rapidity of operation of valve 68 is attributable in significant part to its actuator being of the type wherein a magnetic field is constantly maintained. Such an actuator responds much more quickly to an applied voltage than does a solenoid or similar device whose response is dependent upon either creation or decay of a large magnetic field.

In addition to the above-discussed basic components of the hydraulic mechanism of apparatus 10, such mechanism preferably and illustratively further includes the auxiliary components shown in FIG. 1 and to be now described. The numeral 86 designates an accumulator having an upper chamber that is adapted to contain air or other gas at above-atmospheric pressure and that is separated from a lower chamber of the accumulator by a flexible impervious barrier or diaphragm 88. Suitable fittings 90 communicating with the upper chamber of the accumulator permit pressurized air to be introduced therein, and are also effective to vent air from the chamber if for any reason the pressure thereof should tend to significantly increase during operation of apparatus 10. A multi-branched manifold 92 communicates with and extends from the lower portion of accumulator 86. A first manifold branch containing a check valve 93 communicates with previously-described conduit 62 and permits unidirectional fluid flow from accumulator 86 into such conduit. The same function is performed in association with previously-described conduit 63 by a second branch of manifold 92 that contains a check valve 94. The remaining branch of manifold 92 extends to a port 96 (see also FIG. 3) of valve actuator housing 72 and permits fluid flow between such housing and the accumulator. A fluid passage 98 (FIG. 3) within valve body 74 in turn innerconnects and permits fluid flow between actuator housing 72 and the spring-containing opposite end portions of valve chamber 78.

Prior to initial operation of apparatus 10, hydraulic fluid rendered as free as possible from entrained air and the like is introduced into and completely fills all free space within cylinder 46, conduits 62 and 63, valve body 74 and adjacent actuator housing 72, manifold 92, and the lower chamber of accumulator 86. The above-atmospheric pressure maintained within the upper portion of accumulator 86 assures that the presence of a leaky connection or fitting will not result in air being drawn into the system fluid, and also discourages fluid-cavitation during operation of apparatus 10. Accumulator 86 automatically and immediately replenishes any hydraulic fluid that might be lost by leakage from any part of the hydraulic mechanism. Additionally, the branch of manifold 92 interconnecting accumulator 86 and valve housing 72 assures that the hydraulic-fluid pressure within housing 72 and within the therewith-communicating opposite end portions of valve chamber 78 remains at all times of a low magnitude nonobstructive to rapid operation of valve 68.

Since driven member 18 is movable only in unison with piston 48 of assembly 14 and the latter's cylinder 46 is at all times full of hydraulic fluid, movement of driven member 18 can occur only when, and in proportion to the degree that, valve 68 allows hydraulic to flow via conduits 62, 63 from one to the other of the opposite end portions of cylinder 46. When spool 76 of valve 68 occupies its solid-line position of FIG. 3, wherein the flow of hydraulic is completely blocked, no movement of driven member will occur even though a pneumatic driving force is then being imposed upon it by assembly 12. However, movement of driven member 18 will promptly occur under the impetus of such force when a command signal of control computer 20 directs valve actuator 70 to axially displace valve spool 76 toward or to its phantom-line position of FIG. 3. The velocity of the resulting movement of driven member 18 is governed by and proportional to the extent of the commanded axial displacement of spool 76. Since actuator 70 can effect controlled movement of spool 76 to any of a substantially limitless number of different positions intermediate its solid line and phantom-like ones, the number of possible intermediate velocities of driven member 18 is correspondingly large. The precision and rapidity with which actuator 70 can effect changes in the position of valve spool 78 further permits accelerations of member 18 to be achieved smoothly and in a non-abrupt manner when that is desirable.

Figure 4:
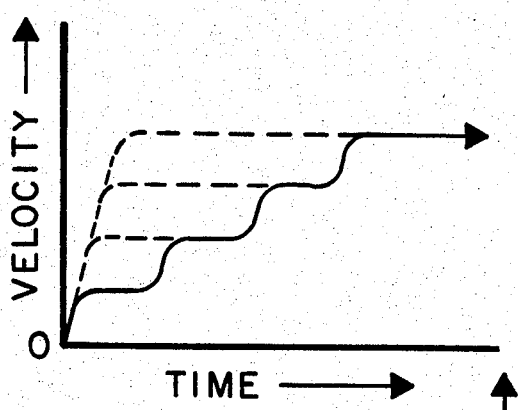
FIGS. 4 and 5 are graphs indicating some of the relative control capabilities of the apparatus and other hydropneumatic drives.
Figure 5:
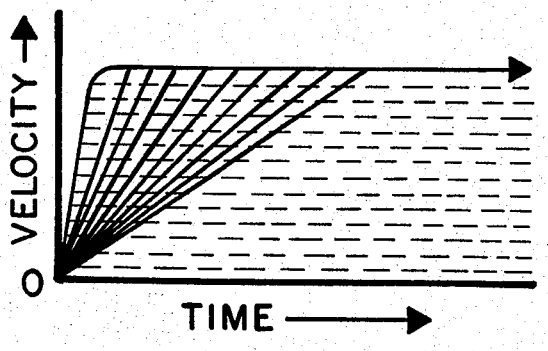

Some of the relative capabilities of apparatus 10 and of prior-art hydropneumatic apparatuses are indicated in the graphs of FIGS. 4 and 5 showing velocity/time plots of illustrative movements of their driven members. As FIG. 4 indicates, those prior art apparatuses employing a plurality of two-condition valves can vary the velocity of a driven member between the maximum attainable and a few lesser velocities each of predetermined and preset magnitude. The driven member may be brought to its maximum or other desired velocity either directly (as indicated by dash lines) or in stepped fashion, but in either case undergoes abrupt and uncontrolled acceleration. The control capabilities of the present apparatus 10 encompass those of the prior hydropneumatic apparatuses, and allow ready duplication of the FIG. 4 performance thereof if such should be desired, and extend far therebeyond. The differing velocities at which member 18 can be controllably driven by apparatus 10 are not limited to a few preset magnitudes, but rather are countless: they include all of those indicated by dash lines in FIG. 5 and others not shown. The solid lines of FIG. 5 indicate the ability of apparatus 10 to cause member 18 to be moved at any desired rate from a zero velocity to its maximum attainable velocity. This particular showing is, of course, illustrative only, since apparatus 10 can, with equal versatility and facility, control substantially all accelerations of member 18, irrespective of whether they are positive or negative ones, between any velocities of differing magnitudes.

While it has been previously stated that the prior art apparatuses can effect constant velocity movement of a driven member at one or a few speeds below the maximum attainable, even that limited capability is dependent at least at times upon the other forces upon the driven member being substantially constant. If, for example, a large-magnitude change in the load upon the driven member should occur while the same is being moved at a constant speed, an undesired speed change could ensue since the prior art apparatuses would not effect an offsetting variation in the degree of restriction of the flow of hydraulic fluid. Apparatus 10, on the other hand, immediately detects the commencement of any undesired changes in the driven member's speed and/or acceleration and immediately and continuously effects offsetting variations in the restriction of fluid flow by valve 68.

In addition to controlling the travel of member 18 between different positions along its path of movement, apparatus 10 may and normally will also be employed to at times maintain member 18 at or within close tolerances of one or more of such positions. Apparatus 10 is well adapted to perform this "position maintenance" function. Unlike the prior-art apparatuses, it can rapidly and precisely effect quite small position-correcting movements of member 18, and the previously described monitoring means 16 of the apparatus is not limited to detection of only such gross movements of member 18 as in effect span the distance between spaced indicia of a reference device.

A generally accepted premise of dynamic-system management is that the quality of the control achieved is to some extent proportional to the number of system variables that are taken into consideration. In addition to the system-dynamics data derived directly or indirectly by computer 20 from monitoring means 16, the computer therefore might also advantageously employ data from monitors of other dynamic variables of apparatus 10 and/or the robot or the like of which driven member 18 forms a part. Among the many additional dynamic variables of apparatus 10 that also could be monitored are, for example, the pressure and/or temperature and/or flow rates of the fluid or air within each or selected ones of the components of the apparatus.

Although a preferred embodiment of the invention has been specifically shown and described, this was for purposes of illustration only, and not for purposes of limitation, the scope of the invention being in accordance with the following claims.

I claim:

1. In a hydropneumatic drive apparatus for imparting controlled movement to a driven member moveable between spaced positions along a path of travel; said apparatus including an active pneumatic mechanism and a passive hydraulic mechanism connected with each other and with said member such that movements imparted to said driven member by said pneumatic mechanism produce, and are retarded by restriction of, flow of hydraulic fluid within said hydraulic mechanism, the improvement comprising:

said passive hydraulic mechanism including valve means responsive to command signals directed thereto for varying said flow of fluid within said hydraulic mechanism between a condition of substantially unrestricted fluid flow, a condition of substantially completely restricted fluid flow, and a substantially limitless number of partially restricted fluid-flow conditions;

and signal-producing control means for directing command signals to said valve means causing the same to so vary said fluid-flow conditions as to control speeds and accelerations of said movements imparted to said driven member by said active pneumatic mechanism.

2. An apparatus as in claim 1, wherein said control means includes a programmable computer, and said command signals of said control means are based at least in part upon a pre-selected program of desired movement of said driven member.

3. An apparatus as in claim 1, and further including driven-member monitoring means operatively associated with said control means for determining the position of said driven member at any location along said path of travel thereof.

4. An apparatus as in claim 3, wherein said control means includes a programmable computer, and said commond signals are based upon a correlation of actual movements of said driven member detected by said monitoring means and program-indicated desired movements of said driven member.

5. An apparatus in claim 4, wherein said valve means comprises a valve member moveable between a substantially infinite number of positions for varying said fluid flow conditions, and torque motor means for moving said valve body between said positions thereof in response to said control signals, said torque motor means including means continuously creating a magnetic field during operation of said apparatus, and an armature member mounted within said field for producing controlled movement of said valve member in response to variations in voltage of said control signals.

6. An apparatus in claim 5, wherein said hydraulic mechanism further includes accumulator means for maintaining said hydraulic fluid at above atmospheric pressure.

7. Apparatus as in claim 1, wherein said valve means includes a valve body having a cylindrical chamber therein, said flow of hydraulic fluid being across a medial portion of said chamber, a valve spool slidable longitudinally of said chamber and in differing longitudinal positions thereof establishing said conditions of substantially completely restricted and partially restricted and substantially unrestricted fluid flow, torque motor means for imparting longitudinal movement to said spool of magnitudes proportional to the voltages of said command signals, housing means connected to said valve body and enclosing said torque motor, and means for permitting pressure-induced passage of hydraulic fluid between opposite end portions of said chamber and said housing.

8. Apparatus as in claim 7, wherein said pneumatic mechanism and said hydraulic mechanism each includes a piston and cylinder assembly having a piston rod, and means connecting said assembly rods and said driven member together for simultaneous movement thereof in unison with each other.

9. An apparatus as in claim 1, wherein said control signals and said valve means substantially continuously vary said fluid-flow conditions during at least some periods of acceleration of said driven member.

10. An apparatus as in claim 1, wherein during movement of said driven member at a substantially constant desired velocity, said control signals and said valve means vary said fluid-flow conditions when and as required to offset incipient changes of said desired velocity of said driven member.

* * * * *